US007928048B2

(12) United States Patent
Oki et al.

(10) Patent No.: US 7,928,048 B2
(45) Date of Patent: Apr. 19, 2011

(54) SOFTENING DETERGENT COMPOSITION

(75) Inventors: Toshihiro Oki, Wakayama (JP); Motomitsu Hasumi, Wakayama (JP); Yoshiyuki Komatsu, Wakayama (JP); Hiroshi Nishimura, Wakayama (JP)

(73) Assignee: Kao Corporation, Tokyo (JP)

( * ) Notice: Subject to any disclaimer, the term of this patent is extended or adjusted under 35 U.S.C. 154(b) by 547 days.

(21) Appl. No.: 10/584,316

(22) PCT Filed: Dec. 22, 2004

(86) PCT No.: PCT/JP2004/019700

§ 371 (c)(1),
(2), (4) Date: Jun. 23, 2006

(87) PCT Pub. No.: WO2005/063958

PCT Pub. Date: Jul. 14, 2005

(65) Prior Publication Data

US 2007/0142265 A1 Jun. 21, 2007

(30) Foreign Application Priority Data

Dec. 26, 2003 (JP) ..... 2003-433037
Dec. 26, 2003 (JP) ..... 2003-433062

(51) Int. Cl.
*C11D 3/39* (2006.01)
*C11D 3/00* (2006.01)

(52) U.S. Cl. ..... 510/309; 510/367; 510/375

(58) Field of Classification Search ..... 510/309, 510/367, 375
See application file for complete search history.

(56) References Cited

U.S. PATENT DOCUMENTS

| | | | | |
|---|---|---|---|---|
| 3,860,694 | A * | 1/1975 | Jayawant | 423/307 |
| 2002/0128165 | A1 * | 9/2002 | Baker et al. | 510/309 |

FOREIGN PATENT DOCUMENTS

| | | | |
|---|---|---|---|
| EP | 0 297 673 | * | 1/1989 |
| EP | 0 483 411 | | 5/1992 |
| EP | 0 530 958 | | 3/1993 |
| GB | 1 400 898 | * | 7/1975 |
| JP | 49 85102 | | 8/1974 |
| JP | 5 140869 | | 6/1993 |
| JP | 8 506843 | | 7/1996 |
| JP | 2002-194391 | | 7/2002 |
| JP | 2002 249799 | | 9/2002 |
| JP | 2002 541342 | | 12/2002 |
| WO | 95 33038 | | 12/1995 |

* cited by examiner

*Primary Examiner* — William K Cheung
(74) *Attorney, Agent, or Firm* — Oblon, Spivak, McClelland, Maier & Neustadt, L.L.P.

(57) ABSTRACT

A softening detergent composition containing (a) 1 to 30% by mass of a clay mineral; (b) 0.5 to 20% by mass of a compound capable of releasing hydrogen peroxide in water; (c) 0.1 to 20% by mass of a compound represented by the following general formula (I) or (II): wherein $R^1$ is an alkyl alkyl group having 4 to 13 carbon atoms; $R^2$ is an alkyl group having 5 to 13 carbon atoms; M is hydrogen atom, or alkali metal atom, alkaline earth metal atom, ammonium or alkanolamine, or a combination of both; and 10 to 60% by mass of a component corresponding to a surfactant as prescribed in JIS K 3362: 1998, wherein a mass ratio of the component (b) to the component (c) [component (b)/component (c)] is from 3/4 to 20/1. The softening detergent composition is suitably used as a softening detergent for fibrous manufactured articles such as clothes.

(1)

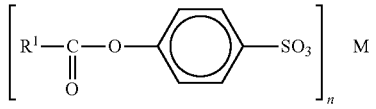

(2)

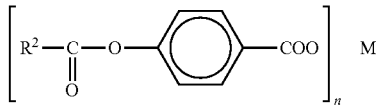

12 Claims, No Drawings

SOFTENING DETERGENT COMPOSITION

FIELD OF THE INVENTION

The present invention relates to a softening detergent composition containing a clay mineral as a softening base agent, a softening washing method of a fibrous manufactured article with the softening detergent composition, and a method of enhancing softening effect with the softening detergent composition.

BACKGROUND OF THE INVENTION

Conventionally, there has been studied to blend a softening agent to a detergent for the purpose of preventing the loss of softness to have a stiff feel of the washed fibrous manufactured article due to the detachment of a fiber treating agent, deposition of salts or the like. As a softening agent for giving softening ability to the feel of the fibrous manufactured article by the deposition of the softening agent on the fiber surface, there has been conventionally used a clay material such as smectite (for instance, JP-A-Sho-49-85102); a cationic surfactant such as a dialkyl-type quaternary ammonium salt (for instance, Technical Publication Shuchi and Kanyo Gijutsu Shu (Clothes Powder Detergent: Japanese Patent Office, published on Mar. 26, 1998)); a silicone such as poly(dimethyl siloxane) (for instance, JP-A-2002-249799); and the like. However, these softening agents did not give sufficient softening effects to the detergent.

In recent years, studies have been made on a method of enhancing softening effects of a clay mineral from the viewpoint of easiness in formulation, environmental issue and the like. For instance, there have been known a combined use of bentonite and a pentaerythritol compound (for instance, JP-A-Hei-5-140869), a combined use of a clay mineral and an aggregating agent (for instance, JP-A-2002-541342), a combined use of bentonite and a soluble potassium salt (for instance, JP-A-Hei 8-506843, and Technical Publication Shuchi and Kanyo Gijutsu Shu (Clothes Powder Detergent: Japanese Patent Office, published on Mar. 26, 1998)), and the like. However, there has not yet attained to give a softening ability in the washing process.

SUMMARY OF THE INVENTION

The present invention relates to:

[1] a softening detergent composition containing:

(a) 1 to 30% by mass of a clay mineral;

(b) 0.5 to 20% by mass of a compound capable of releasing hydrogen peroxide in water;

(c) 0.1 to 20% by mass of a compound represented by the following general formula (1) or (2):

(1)

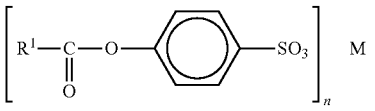

(2)

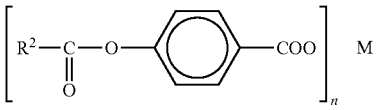

wherein $R^1$ is an alkyl group having 4 to 13 carbon atoms; $R^2$ is an alkyl group having 5 to 13 carbon atoms; M is a hydrogen atom, or an alkali metal atom, an alkaline earth metal atom, an ammonium or an alkanolamine, with proviso that when M is an alkaline earth metal atom, n is 2, and that when M is an alkali metal atom, an ammonium or an alkanolamine, n is 1, or a combination of both; and 10 to 60% by mass of a component corresponding to a surfactant as prescribed in JIS K 3362:1998, wherein a mass ratio of the component (b) to the component (c) [component (b)/component (c)] is from 3/4 to 20/1;

[2] a softening washing method of a fibrous manufactured article, including the step of washing an article to be washed with the softening detergent composition of the above [1]; and

[3] a method of enhancing softening effect of a clay mineral against a fibrous manufactured article, including the step of applying to the fibrous manufactured article, (a) a clay mineral;

(b) a compound capable of releasing hydrogen peroxide in water; and (c) a compound represented by the following general formula (1) or (2):

(1)

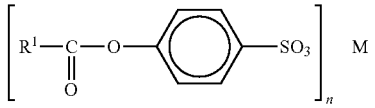

(2)

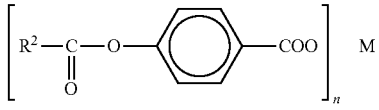

wherein $R^1$ is an alkyl group having 4 to 13 carbon atoms; $R^2$ is an alkyl group having 5 to 13 carbon atoms; M is a hydrogen atom, or an alkali metal atom, an alkaline earth metal atom, an ammonium or an alkanolamine, with proviso that when M is an alkaline earth metal atom, n is 2, and that when M is an alkali metal atom, an ammonium or an alkanolamine, n is 1, or a combination of both, in mass ratios satisfying:

the component (b)/the component (c)=3/4 to 20/1, and the component (a)/the component (c)=35/1 to 1/5.

DETAILED DESCRIPTION OF THE INVENTION

The present invention relates to a softening detergent composition capable of giving detergency for an article to be washed such as fibrous manufactured articles and simultaneously giving excellent softening ability to the washed article, wherein the softening detergent composition contains a clay mineral as a softening base agent; a softening washing method of a fibrous manufactured article with the softening detergent composition; and a method of enhancing softening effect with the softening detergent composition.

By using the softening detergent composition of the present invention, there is exhibited an effect that a fibrous manufactured article or the like having excellent softness can be washed.

These and other advantages of the present invention will be apparent from the following description.

1. Softening Detergent Composition

One of the greatest features of the softening detergent composition resides in that a softening detergent composition contains:

(a) 1 to 30% by mass of a clay mineral;

(b) 0.5 to 20% by mass of a compound capable of releasing hydrogen peroxide in water;

(c) 0.1 to 20% by mass of a compound represented by the following general formula (1) or (2):

(1)

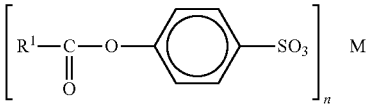

(2)

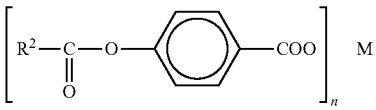

wherein $R^1$ is an alkyl group having 4 to 13 carbon atoms; $R^2$ is an alkyl group having 5 to 13 carbon atoms; M is a hydrogen atom, or an alkali metal atom, an alkaline earth metal atom, an ammonium or an alkanolamine, with proviso that when M is an alkaline earth metal atom, n is 2, and that when M is an alkali metal atom, an ammonium or an alkanolamine, n is 1, or a combination of both; and 10 to 60% by mass of a component corresponding to a surfactant as prescribed in JIS K 3362:1998, wherein a mass ratio of the component (b) to the component (c) [component (b)/component (c)] is from 3/4 to 20/1.

In the present invention, since the softening detergent composition has the above feature, there is exhibited an effect that an article to be washed such as a fibrous manufactured article having excellent softening ability can be washed.

In the present invention, the softening ability means softness and smoothness upon feeling the clothes, and examples of the fibrous manufactured article include towels, bath towels, T-shirts, sweat shirts and the like.

The softening detergent composition of the present invention will be described in further detail hereinbelow.

<Component (a)>

The softening detergent composition of the present invention contains 1 to 30% by mass of a clay mineral as the component (a). The content of the component (a) of the softening detergent composition is preferably from 2 to 25% by mass, more preferably from 4 to 20% by mass, even more preferably from 6 to 18% by mass, even more preferably from 8 to 15% by mass, from the viewpoint of softening ability and detergency.

The component (a) includes talc, pyrophyllite, smectites such as saponite, hectorite, sauconite, stevensite, montmorillonite, beidellite and nontronite, vermiculites, micas such as phlogopite, biotite, zinnwaldite, muscovite, paragonite, celadonite and glauconite, chlorites such as clinochlore, chamosite, nimite, pennantite, sudoite and donbassite, brittle micas such as clintonite and margarite, thulite, serpentines such as antigorite, lizardite, chrysotile, amesite, cronstedtite, berthierine, greenalite and garnierite (nepouite), kaolin minerals such as kaolinite, dickite, nacrite and halloysite, and the like. Among them, talc, smectites, swellable micas, vermiculites, chrysotile, the kaolin minerals and the like are preferable, from the viewpoint of softening ability, the smectites are more preferable, and montmorillonite is even more preferable. These clay minerals can be used alone or in proper combination of two or more kinds.

In addition, the component (a) is preferably a clay mineral represented by the following general formula (3):

$$[Si_8(Mg_aAl_b)O_{20}(OH)_4]^{x-}.Me^{x+}$$

wherein each of a, b and x satisfies $0<a\leqq 6$, $0<b\leqq 4$, $x=12-2a-3b$, and Me is at least one member selected from the group consisting of Na, K, Li, $Ca^{1/2}$, $Mg^{1/2}$ and $NH_4$. Examples of the clay mineral represented by the general formula (3) include "Laundrosil DGA212," "Laundrosil PR414" and "Laundrosil DGA Powder" commercially available from Sid-Chemie; "Detersoft G1S", "Detersoft G1B" and "Detersoft G1SW" commercially available from Laviosa; an the like. The terms within quotation marks indicate trade names.

These components (a) may be a natural product or a synthetic product.

<Component (b)>

The softening detergent composition of the present invention contains 0.5 to 20% by mass of a compound capable of releasing hydrogen peroxide in water as the component (b). The content of the component (b) is preferably from 1.5 to 20% by mass, more preferably from 2 to 16% by mass, even more preferably from 2.5 to 13% by mass, even more preferably from 3 to 10% by mass, even more preferably from 3.5 to 8% by mass, of the softening detergent composition, from the viewpoint of softening ability and detergency.

In addition, when the softening detergent composition contains a salt of a fatty acid (d) as mentioned below, the content of the component (b) is preferably from 1 to 16% by mass, more preferably from 1.5 to 13% by mass, even more preferably from 2 to 10% by mass, even more preferably from 2.5 to 8% by mass, of the softening detergent composition.

The component (b) includes carbonate-hydrogen peroxide adducts, borate-hydrogen peroxide adducts, tripolyphosphate-hydrogen peroxide adducts, pyrophosphate-hydrogen peroxide adducts, urea-hydrogen peroxide adducts, and the like. Among them, carbonate-hydrogen peroxide adducts and borate-hydrogen peroxide adducts are preferable, and sodium carbonate-hydrogen peroxide adduct and sodium borate-hydrogen peroxide adduct are more preferable. Sodium borate-hydrogen peroxide adduct is even more preferable from the viewpoint of detergency at a high temperature, and sodium carbonate-hydrogen peroxide adduct is even more preferable from the viewpoint of detergency at a low temperature.

In addition, it is preferable that the component (b) is coated with an inorganic compound, an organic compound or the like, from the viewpoint of storage stability. The inorganic compound includes boric acids, borates, sodium carbonate, sodium sulfate, magnesium sulfates, magnesium silicate, magnesium chloride, magnesium oxide, sodium silicate and the like. The organic compound includes polyethylene glycol, polyvinyl pyrrolidone, hydroxypropyl cellulose and the like. Among them, it is preferable that the component (b) is at least one coated with a boric acid or a borate. The boric acid includes orthoboric acid, metaboric acid, tetraboric acid and the like, and the salt thereof includes salts of alkali metals such as sodium and potassium.

The component (b) can be coated with the above-mentioned inorganic compound or organic compound in accordance with the method described, for instance, in JP-A-Sho 59-196399. The amount of the component (b) is preferably from 50 to 95% by mass, more preferably from 70 to 90% by mass, of the granule containing the component (b). When the above-mentioned component (b) is used as the granule containing the component (b), the amount of the inorganic compound or organic compound used in the coating is preferably from 0.5 to 20% by mass, more preferably from 1 to 10% by mass, of the granule, from the viewpoint of stability and dissolubility. In addition, a conventionally known stabilizer, dissolution accelerator, chelating agent or the like may be contained in the above-mentioned granule. Among them, chlorides, urea, anionic surfactants and nonionic surfactants are preferable from the viewpoint of dissolubility. The ratio of each of these components is preferably from 0.1 to 5% by mass of the above-mentioned granule.

<Component (c)>

The softening detergent composition of the present invention contains 0.1 to 20% by mass of the compound represented by the above-mentioned formula (1) or (2), or a combination of both, as the component (c). The content of the component (c) is preferably from 1.5 to 20% by mass, more preferably from 2 to 16% by mass, even more preferably from 2.5 to 13% by mass, even more preferably from 3 to 10% by mass, even more preferably from 3.5 to 8% by mass, of the softening detergent composition, from the viewpoint of softening ability and detergency.

In addition, when the softening detergent composition contains the salt of a fatty acid (d) mentioned below, the content of the component (c) is preferably from 0.5 to 16% by mass, more preferably from 0.6 to 13% by mass, even more preferably from 0.7 to 10% by mass, even more preferably from 0.8 to 8% by mass.

In the above-mentioned general formulas (1) and (2), each of $R^1$ and $R^2$ is preferably an alkyl group or alkenyl group, more preferably an alkyl group, having 7 to 18 carbon atoms, more preferably 10 to 13 carbon atoms, from the viewpoint of detergency. In addition, M is preferably an alkali metal atom, among which sodium and potassium are preferable, and sodium is even more preferable.

The component (c) is a compound capable of generating an organic peracid by the reaction with hydrogen peroxide, specifically hydrogen peroxide released from the component (b), in water. In the present invention, since the softening detergent composition contains the component (c), there is an advantage of improving softening effects as compared to the case where the component (a) is used alone. Here, the organic peracid refers to a peroxide generated by the reaction of the component (c) with hydrogen peroxide derived from the component (b).

When the component (c) is formulated in the softening detergent composition, it is preferable that the component (c) is formulated in the form of a granule containing the component (c), from the viewpoint of stability. The amount of the component (c) is preferably from 1 to 80% by mass, more preferably from 20 to 80% by mass, even more preferably from 30 to 75% by mass, of the granule containing the component (c). In addition, for the purpose of improving dissolubility of the component (c) in a washtub, at least one surfactant selected from the group consisting of polyoxyalkylene alkyl ethers, alkyl sulfates and polyoxyalkylene alkyl ether sulfates is formulated in the granule containing the component (c) in an amount of preferably from 0 to 50% by mass, more preferably from 1 to 45% by mass, even preferably from 2 to 40% by mass.

The polyoxyalkylene alkyl ether is preferably those in which ethylene oxide and propylene oxide are added in block form, and an average mole of ethylene oxide added is preferably from 3 to 20, more preferably from 4 to 15, and an average mole of propylene oxide is preferably from 1 to 10, more preferably from 2 to 7. The alkyl moiety has preferably from 10 to 18 carbon atoms, more preferably from 12 to 16 carbon atoms.

The alkyl sulfate is preferably those having 10 to 18 carbon atoms, and being a sodium salt, and sodium lauryl sulfate or sodium myristyl sulfate is more preferable.

The polyoxyalkylene alkyl ether sulfate is preferably a polyoxyethylene alkyl ether sulfate of which alkyl moiety has 10 to 18 carbon atoms, and a sodium salt thereof is favorable. Here, the average degree of polymerization of the polyoxyethylene group (hereinafter referred to as "EOp") is preferably from 1 to 10, more preferably from 1 to 5, and sodium polyoxyethylene (EOp=2-5) lauryl ether sulfate and sodium polyoxyethylene (EOp=2-5) myristyl ether sulfate are even more preferable.

The granule containing the component (c) may be prepared by forming the above-mentioned components into a preparation with a binder substance selected from a polyethylene glycol and a fatty acid.

The polyethylene glycol is one having an average molecular weight of preferably from 2000 to 20000, more preferably from 4000 to 15000, even more preferably from 4000 to 10000. In addition, the fatty acid includes those having preferably from 8 to 20 carbon atoms, more preferably from 10 to 18 carbon atoms, even more preferably from 12 to 18 carbon atoms, and these polyoxyethylene may be in the state of sodium or potassium soap.

It is preferable that the binder substance is used in an amount of from 0.5 to 30% by mass, more preferably from 1 to 20% by mass, even more preferably from 5 to 20% by mass, of the granule containing the component (c).

It is preferable that the above components are formulated in the above-mentioned ratio in the granule containing the component (c), from the viewpoint of storage stability.

In addition, in the present invention, for the purpose of further improving the stability of the granule containing the component (c), an acidic substance may be formulated in the granule containing the component (c). The acidic substance is preferably an organic carboxylic acid, more preferably at least one member selected from the group consisting of succinic acid, maleic acid, fumaric acid, citric acid, glycolic acid and p-hydroxybenzoic acid. The formulation amount of the acidic substance mentioned above is preferably from 0 to 20% by mass, more preferably from 1 to 15% by mass, even more preferably from 1 to 10% by mass, of the granule containing the component (c).

The granule containing the component (c) can be obtained by mixing the above-mentioned components according to a given method. A method of previously mixing the component (c) with all or a part of the above-mentioned surfactant, and thereafter adding the remaining surfactant, the binder substance, the acidic substance or the like to the mixture is even more preferable.

Also, it is preferable that the binder substance is previously melted and then added. It is preferable that the binder substance is melted at 40° to 100° C., more preferably at 50 to 100° C., even more preferably from 50 to 90° C. and then added.

The mixture obtained in the manner described above is mixed while stirring until the mixture becomes homogeneous, and thereafter the mixture is formed into a preparation with a usual granulator.

The preferred granulation method includes extrusion granulation, whereby granules having an average particle size of preferably from 500 to 5000 μm, even more preferably from 500 to 3000 μm can be formed. Alternatively, other preferable granulation method includes a method of forming into a tablet shape with a briquet machine.

<Component (d)>

It is preferable that the softening detergent composition of the present invention contains 0.4 to 20% by mass of the salt of a fatty acid, as the component (d), from the viewpoint of softening ability and detergency. The content of the component (d) is more preferably from 0.6 to 16% by mass, even more preferably from 0.8 to 14% by mass, even more preferably from 1 to 12% by mass, even more preferably from 1 to 10% by mass, of the softening detergent composition.

In the present invention, since the component (d) is used together with the component (c), there are some advantages of further improving softening effects as compared to a case where the component (a) is used alone, or when the components (a) and (c) are used together.

The component (d) is preferably those derived from a fatty acid having an iodine value of from 0 to 150 and a neutralization value of from 50 to 400, more preferably those derived from a fatty acid having an iodine value of from 1 to 100 and a neutralization value of from 100 to 350, even more preferably those derived from a fatty acid having an iodine value of from 2 to 90 and a neutralization value of from 150 to 300, even more preferably those derived from a fatty acid having an iodine value of from 2 to 60 and a neutralization value of from 180 to 280, even more preferably those derived from a fatty acid having an iodine value of from 2 to 20 and a neutralization value of from 230 to 280, from the viewpoint of softening ability. The iodine value is determined as prescribed in JIS K 33415.2, and the neutralization value is determined as prescribed in JIS K 33415.1.

Specific compounds for the component (d) include a salt of a fatty acid of which fatty acid residue has 9 to 21 carbon atoms, preferably 11 to 19 carbon atoms, more preferably 13 to 17 carbon atoms. The preferred compound includes alkali metal salts of myristic acid, palmitic acid, stearic acid, oleic acid, linoleic acid, linolenic acid and the like.

The component (d) is preferably those derived from a fatty acid having a saponification value of from 235 to 280, an iodine value of from 2 to 20 and a neutralization value of from 230 to 280, more preferably those derived from a fatty acid having a saponification value of from 245 to 270, an iodine value of from 4 to 18 and a neutralization value of from 240 to 270, even more preferably those derived from a fatty acid having a saponification value of from 250 to 265, an iodine value of from 6 to 15 and a neutralization value of from 245 to 265, even more preferably those derived from a fatty acid having a saponification value of from 255 to 260, an iodine value of from 8 to 12 and a neutralization value of from 250 to 260, from the viewpoint of softening ability. The saponification value is determined as prescribed in JIS K 33315.3, the iodine value is determined as prescribed in JIS K 33415.2, and the neutralization value is determined as prescribed in JIS K 33415.1.

<Component (e)>

In addition, it is preferable that the softening detergent composition of the present invention contains a builder having at least a function selected from metal chelating function, alkali buffering function and a solid particle dispersing function as a component (e), from the viewpoint of productivity, dissolubility and anti-caking property. The content of the component (e) is more preferably from 20 to 80% by mass, even more preferably from 30 to 70% by mass, even more preferably from 40 to 60% by mass.

The component (e) includes those builders described in "Senzai Senjo no Jiten (Dictionary for Detergents and Washing)," edited by Haruhiko OKUYAMA and Motoi MINAGAWA, Asakura Publishing Company Limited, Nov. 25, 1990, First Edition, p. 56-74.

Among them, the preferred inorganic builders are zeolites, amorphous aluminosilicates, crystalline aluminosilicates, sodium tripolyphosphate, sodium pyrophosphate, carbonates and silicates, and the preferred organic builders are aminocarboxylates, hydroxyaminocarboxylates, hydroxycarbonates, cyclocarbonates, ether carbonates and organic carboxylic acid (carboxylate) polymers. More preferred inorganic builders are zeolites, carbonates and silicates, and more preferred organic builders are organic carboxylic acid (carboxylate) polymers.

<Surfactant Other Than Component (d)>

The softening detergent composition of the present invention may contain a surfactant other than the component (d) mentioned above. The amount of the surfactant other than the component (d) is preferably from 5 to 50% by mass, more preferably from 10 to 30% by mass, of the softening detergent composition.

The surfactant other than the component (d) includes anionic surfactants other than the component (d), nonionic surfactants, cationic surfactants and amphoteric surfactants.

Among them, it is preferable that the softening detergent composition contains the anionic surfactant other than the component (d) from the viewpoint of detergency and softening ability.

The preferred anionic surfactants other than the component (d) are sulfuric acid esters of alcohols having 10 to 18 carbon atoms, sulfuric acid esters of alkoxylates of alcohols having 8 to 20 carbon atoms, alkylbenzenesulfonates, paraffinsulfonates, α-olefinsulfonates, salts of α-sulfofatty acids, and salts of alkyl esters of α-sulfofatty acids. In the present invention, even more preferably, linear alkylbenzenesulfonates of which alkyl moiety has 10 to 14 carbon atoms, more preferably 12 to 14 carbon atoms are preferable. As the counter ions, alkali metal salts and amines are preferable, even more preferably sodium and/or potassium, monoethanolamine and diethanolamine.

The preferred nonionic surfactants are polyoxyalkylene alkyl (8 to 20 carbon atoms) ethers, alkyl polyglycosides, polyoxyalkylene alkyl (8 to 20 carbon atoms) phenyl ethers, polyoxyalkylene sorbitan fatty acid (8 to 22 carbon atoms) esters, polyoxyalkylene glycol fatty acid (8 to 22 carbon atoms) esters, and polyoxyethylene-polyoxypropylene block polymers. Even more preferably, a polyoxyalkylene alkyl ether in which an alkylene oxide such as ethylene oxide or propylene oxide is added to an alcohol having 10 to 18 carbon atoms in an average of from 4 to 20 mol is preferable. The nonionic surfactant has an HLB value of preferably from 10.5 to 15.0, more preferably from 11.0 to 14.5, as calculated by Griffin method.

The cationic surfactant includes long-chained mono- (or di)alkyl quaternary ammonium salts and the like.

The amphoteric surfactants include alkyl dimethylaminoacetate betains, fatty acid aminopropyl betains and the like.

In addition, even when these surfactants are used together with the component (d), it is preferable that the alkylbenzenesulfonate is contained in an amount of from 35 to 70% by mass of the component corresponding to the surfactant other than the component (d), from the viewpoint of softening ability. The content of the alkylbenzenesulfonate is more preferably from 36 to 65% by mass, even more preferably from 37 to 60% by mass, even more preferably from 40 to 55% by mass.

In addition, even when these surfactants are used together with the component (d), it is preferable that the alkylbenzenesulfonate is contained in an amount of from 1 to 20% by mass, more preferably from 3 to 18% by mass, even more preferably from 5 to 16% by mass, even more preferably from 8 to 14% by mass of the softening detergent composition, from the viewpoint of detergency and softening ability.

<Component Corresponding to Surfactants as Prescribed in JIS K 3362:1998>

In addition, the softening detergent composition of the present invention contains 10 to 60% by mass of the component corresponding to the surfactant as prescribed in JIS K 3362:1998.

Here, the component corresponding to the surfactant as prescribed in JIS K 3362:1998 refers to an amount of the surfactant formulated in the detergent composition as determined by the method prescribed as K 3362:1998 under Japanese Industrial Standards (JIS), wherein the amount is obtained by subtracting petroleum ether-soluble matter and urea from ethanol-soluble matter.

The component corresponding to the surfactant as prescribed in JIS K 3362:1998 is preferably from 15 to 50% by mass, more preferably from 18 to 45% by mass, even more preferably from 20 to 40% by mass, of the softening detergent composition, from the viewpoint of detergency and softening ability.

When the softening detergent composition of the present invention contains the components (a), (b) and (c) mentioned above, the amount of the anionic surfactant including the component (d) is preferably 80% by mass or more, more preferably 90% by mass or more, even more preferably 95% by mass or more, of the component corresponding to the surfactant.

In the present invention, when the softening detergent composition of the present invention contains from 4 to 40% by mass of the component (d) mentioned above, the content of the anionic surfactant is preferably 55% by mass or more, more preferably from 56 to 98% by mass, even more preferably from 57 to 95% by mass, even more preferably from 58 to 92% by mass, of the component corresponding to the surfactant, from the viewpoint of softening ability. Here, the amount of the anionic surfactant as referred to herein includes the amount of the component (d) mentioned above.

In addition, the amount of the component (d) is preferably from 4 to 40% by mass, more preferably from 5 to 38% by mass, even more preferably from 6 to 35% by mass, even more preferably from 7 to 30% by mass, of the component corresponding to the surfactant.

In the softening detergent composition of the present invention, the mass ratio of the component (b)/component (c) is from 3/4 to 20/1. This mass ratio is preferably from 3/4 to 7/1, more preferably from 5/6 to 6/1, even more preferably from 9/10 to 5/1, even more preferably from 1/1 to 4/1, from the viewpoint of the softening ability.

In addition, when the softening detergent composition of the present invention contains the component (d), the mass ratio of the component (b)/component (c) is preferably from 1/1 to 20/1, more preferably from 6/5 to 15/1, even more preferably from 3/2 to 10/1, even more preferably from 2/1 to 5/1.

In addition, the mass ratio of the component (a)/component (c) in the softening detergent composition is preferably from 35/1 to 1/5, more preferably from 30/1 to 1/5, even preferably from 15/1 to 1/3, even preferably from 10/1 to 1/2, even preferably from 5/1 to 1/1, from the viewpoint of the softening ability.

In addition, when the softening detergent composition contains the component (d), the mass ratio of the component (a)/component (d) in the softening detergent composition is preferably from 20/1 to 1/5, more preferably from 15/1 to 1/3, even more preferably from 10/1 to 1/2, even more preferably from 5/1 to 1/1, from the viewpoint of softening ability.

The mass ratio of the component (a)/the component corresponding to the surfactant as prescribed in JIS K3362:1998 in the softening detergent composition is preferably from 2/1 to 1/50, more preferably from 3/2 to 1/10, even more preferably from 1/1 to 1/5, even more preferably from 3/4 to 1/3, from the viewpoint of detergency and softening ability.

<Water>

In addition, the softening detergent composition preferably contains water in an amount of from 0.1 to 10% by mass, as determined by water content in accordance with loss on heating method as prescribed in JIS K3362:1998, more preferably from 0.2 to 6% by mass, even more preferably from 0.5 to 4% by mass, even more preferably from 0.5 to 3% by mass, from the viewpoint of storage stability and productivity.

<Surface-Modifying Agent>

The softening detergent composition of the present invention may be surface-modified with a surface-modifying agent from the viewpoint of free-flowability and anti-caking property. The surface-modifying agents include, for instance, silicate compounds such as aluminosilicates, calcium silicates, silicon dioxide, amorphous silica derivatives, and crystalline silicate compounds; metal soaps; fine powders such as powdery surfactants; water-soluble polymers such as carboxymethyl cellulose, polyethylene glycol, polycarboxylates such as sodium polyacrylates, copolymers of acrylic acid and maleic acid or salts thereof; fatty acids and the like. More preferable are aluminosilicates and crystalline silicate compounds, and even more preferable are aluminosilicates. The content of the surface-modifying agent is preferably 20% by mass or less, more preferably 15% by mass or less, even more preferably 10% by mass or less, of the softening detergent composition of the present invention, from the viewpoint of storage stability. The content of the surface-modifying agent is preferably 1% by mass or more, more preferably 3% by mass or more, even more preferably 5% by mass or more, of the softening detergent composition of the present invention, from the viewpoint of surface modification. In addition, a part of the clay mineral of the component (a) may be used as a surface-modifying agent.

<Other Components>

The softening detergent composition of the present invention can contain agents for suppressing redeposition such as carboxymethyl cellulose, other softening agents, fluorescers, defoaming agents such as silicones, enzymes, enzyme stabilizers, colorants, perfumes and the like, which are known in the field of laundry detergents.

The softening detergent composition of the present invention having the components as described above can be prepared by mixing each of the above-mentioned components by a known method.

2. Properties of Softening Detergent Composition

The softening detergent composition of the present invention is preferably in the form of powder or tablet, from the viewpoint of stability, and the powder form is more preferable. The average particle size of the softening detergent composition is preferably from 200 to 1000 μm, more preferably from 250 to 900 μm, even more preferably from 300 to 800 μm, as determined from the particle size determined by a sieving method with a sieving machine as prescribed in JIS K 3362:1998, from the viewpoint of low-temperature dissolubility and stability. The bulk density of the softening detergent composition is preferably from 300 to 1200 g/L, more preferably from 400 to 1100 g/L, even more preferably from 600 to 1000 g/L, even more preferably from 700 to 980 g/L, as determined by the method as prescribed in JIS K 3362:1998, from the viewpoint of low-temperature dissolubility and stability.

A 0.05% by mass aqueous solution of the softening detergent composition has a pH of preferably from 8 to 12, more preferably from 9 to 11.5, even more preferably from 9.5 to 11, even more preferably from 10 to 11, as determined by the method prescribed in JIS K3362:1998 at 20° C., from the viewpoint of detergency, softening ability, and damaging ability.

The softening detergent composition has a calcium capturing capacity of preferably from 20 to 300 $CaCO_3$ mg/g, more preferably from 50 to 200 $CaCO_3$ mg/g, even more preferably from 100 to 150 $CaCO_3$ mg/g, as determined by the following determination method, from the viewpoint of detergency and softening ability.

(Method for Determination of Calcium Capturing Capacity)

The calcium capturing capacity (amount of calcium ions captured) is obtained in accordance with the method described in JP-A-Hei 3-277696, page 3, lower right column, line 6 to page 4, upper left column, line 6 (provided that the anionic surfactant should read as a softening detergent composition).

3. Softening Washing Method of Fibrous Manufactured Article

The softening washing method of a fibrous manufactured article of the present invention includes the step of washing an article to be washed with the above-mentioned softening detergent composition.

In this softening washing method, the article to be washed includes fibrous manufactured articles made from natural fibers such as cotton, flax and wool; regenerated fibers such as rayon and cupraammonium rayon; semi-synthetic fibers such as acetate; synthetic fibers such as nylon, polyester and acrylic.

In addition, the washing method employed in the above-mentioned method of enhancing softening effect may be an ordinarily known method used in washing a fibrous manufactured article, and the washing conditions such as temperature and washing machine are not particularly limited.

4. Method of Enhancing Softening Effect of Clay Mineral Against Fibrous Manufactured Article One of the greatest feature of the method of enhancing a softening effect of a clay mineral against a fibrous manufactured article of the present invention (hereinafter also referred to as "method of enhancing a softening effect") resides in that the component (a), the component (b) and the component (c) are applied to the fibrous manufactured article in mass ratios satisfying the component (*b*)/the component (*c*)=3/4 to 20/1, and the component (*a*)/the component (*c*)=35/1 to 1/5.

By having the above feature, the softening effect of the component (a), the clay mineral, against the fibrous manufactured article is enhanced.

In the method of enhancing a softening effect of the present invention, the mass ratio of the component (b)/the component (c) is from 3/4 to 20/1. This mass ratio is preferably from 3/4 to 7/1, more preferably from 5/6 to 6/1, even more preferably from 9/10 to 5/1, even more preferably from 1/1 to 4/1, from the viewpoint of softening ability.

In addition, the mass ratio of the component (a)/the component (c) is from 35/1 to 1/5. This mass ratio is preferably from 30/1 to 1/5, more preferably from 15/1 to 1/3, even more preferably from 10/1 to 1/2, even more preferably from 5/1 to 1/1, from the viewpoint of softening ability.

Here, the mass ratios of each of the components mentioned above are ratios calculated from the final mass of each component used in the method of enhancing a softening effect.

In addition, in the method of enhancing a softening effect of the present invention, it is preferable that the component (a), the component (b), the component (c) and the component (d) are applied to the fibrous manufactured article in mass ratios satisfying:

the component (*b*)/the component (*c*)=20/1 to 1/1, the component (*a*)/the component (*c*)=35/1 to 1/5, and the component (*a*)/the component (*d*)=20/1 to 1/5.

In this case, the mass ratio of the component (b)/the component (c) is preferably from 20/1 to 1/1, more preferably from 15/1 to 6/5, even more preferably from 10/1 to 3/2, even more preferably from 5/1 to 2/1, from the viewpoint of softening ability.

The mass ratio of the component (a)/the component (c) is preferably from 35/1 to 1/5, more preferably from 15/1 to 1/3, even more preferably from 10/1 to 1/2, even more preferably from 5/1 to 1/1, from the viewpoint of softening ability.

The mass ratio of the component (a)/the component (d) is preferably from 20/1 to 1/5, more preferably from 15/1 to 1/3, even more preferably from 10/1 to 1/2, even more preferably from 5/1 to 1/1, from the viewpoint of softening ability.

Here, the mass ratios of each of the components mentioned above are ratios calculated from the final mass of each component used in the method of enhancing a softening effect.

Specific embodiments of the method of enhancing a softening effect of the present invention may be carried out in any manner as long as the component (a), the component (b) and the component (c) are supplied to a washtub in the ratio mentioned above. For instance, a composition containing the three components may be supplied at once, or the component (a) and a composition containing the component (b) and the component (c) may be supplied separately. The former method is preferable from the viewpoint of simplicity.

In addition, when the component (d) is used, a composition containing the four components may be supplied at once, or a composition containing the component (a) and the component (d), and a composition containing the component (b) and the component (c) may be supplied separately. The former method is preferable from the viewpoint of simplicity.

EXAMPLES

The following examples further describe and demonstrate embodiments of the present invention. The examples are given solely for the purposes of illustration and are not to be construed as limitations of the present invention.

Examples I-1 to I-3 and Comparative Examples I-1 to I-3

A detergent base was obtained from components excluding a clay mineral, a bleaching agent granule, a bleaching activator granule, an enzyme, a perfume, and 3% by mass of a zeolite for surface modification. To the detergent base were added and mixed the clay mineral, the bleaching agent granule, the bleaching activator granule, the enzyme, the perfume, and 3% by mass of the zeolite for surface modification, to give a softening detergent composition. The components of the softening detergent composition are shown in Table 1.

All of the obtained softening detergent compositions had a pH of their 0.05% by mass aqueous solutions in the range of from 10 to 11, as determined by the method as prescribed in JIS K3362:1998 at 20° C., an amount of calcium ions captured in the range of from 50 to 200 $CaCO_3$ mg/g, an average particle size in the range of from 300 to 800 μm, and a bulk density in the range of from 700 to 980 g/L.

TABLE 1

| Components (% by mass) of Softening Detergent | Examples | | | Comparative Examples | | |
|---|---|---|---|---|---|---|
| Composition | I-1 | I-2 | I-3 | I-1 | I-2 | I-3 |
| Component a | | | | | | |
| Clay Mineral | 10 | 10 | 18 | 10 | 10 | 10 |
| Component b | | | | | | |
| Bleaching Agent Granule 1 | | | 5 | | | |
| Bleaching Agent Granule 2 | 7 | 3 | | | | 7 |
| Bleaching Activator Granule 1 | | | 2 | | | |
| Component c | | | | | | |
| Bleaching Activator Granule 2 | 7 | | 2 | | 7 | |
| Bleaching Activator Granule 3 | | 2.5 | | | | |
| LAS-Na | 20 | 20 | 13 | 20 | 20 | 20 |
| AS-Na | | | 5 | | | |
| Nonionic Surfactant 1 | | | 1 | | | |
| Component e | | | | | | |
| Crystalline Silicate | 2 | 2 | | 2 | 2 | 2 |
| No. 2 Silicate | 1 | 1 | 6 | 1 | 1 | 1 |
| Zeolite | 18 | 18 | 16 | 18 | 18 | 18 |
| Sodium Carbonate | 22 | 22 | 15 | 22 | 22 | 22 |
| Potassium Carbonate | | | 5 | | | |
| Sodium Sulfate | 5 | 13.5 | 5 | 19 | 12 | 12 |
| PEG | 1 | 1 | | 1 | 1 | 1 |
| AA Polymer | | | 3 | | | |
| AA/MA Polymer | 3 | 3 | | 3 | 3 | 3 |
| Others | | | | | | |
| Fluorescer | 0.2 | 0.2 | 0.2 | 0.2 | 0.2 | 0.2 |
| Enzyme | 0.5 | 0.5 | 0.5 | 0.5 | 0.5 | 0.5 |
| Perfume | 0.3 | 0.3 | 0.3 | 0.3 | 0.3 | 0.3 |
| Water | 3 | 3 | 3 | 3 | 3 | 3 |

The detergency and the softening ability of the resulting softening detergent compositions were evaluated in accordance with the following methods. The results are shown in Table 2.

(Preparation of Cloths with Sebum Dirt Stains on Collar)

The cloths with sebum dirt stains on collar as prescribed in JIS K3362:1998 was prepared.

(Washing Conditions and Evaluation Method)

The detergency of the softening detergent compositions of Table 1 was compared to that of the detergency-judging index detergent in accordance with the method for evaluating detergency for laundry synthetic detergents as prescribed in JIS K 3362:1998. Here, the used concentration of the softening detergent composition of Table 1 was 1.0 g/L.

Evaluation Criteria:

A: The detergency is higher than that of the index detergent.

B: The detergency is of the same level as that of the index detergent.

C: The detergency is lower than that of the index detergent.

(Preparation of Towel for Evaluation)

A commercially available cotton towel (cotton 100%) was pre-treated with a 0.5 g/L solution of a pretreatment mixture prepared by mixing a nonionic surfactant (ethylene oxide adduct prepared by adding ethylene oxide in an average of 6 mol to a primary alcohol having 12 carbon atoms), a crystalline silicate ("Prefeed Granules") and sodium carbonate in a weight ratio of 1:1:3 using a mini-wash machine ("N-BK2" commercially available from National Panasonic, Matsushita Electric Industrial Co., Ltd.). At a water temperature of 20° C., a cycle of washing for 7 minutes, a centrifugal spin-drying, a 3-minute rinsing, spin-drying, a 3-minute rinsing and spin-drying was repeated for a total of five times, to remove the pretreatment mixture, to give a towel for evaluation (pre-treated towels).

(Washing Conditions and Evaluation Method)

1.0 g of the softening detergent composition of Table 1 was dissolved in 5 L of water at 20° C., and 0.3 kg of cotton towels (4 pieces of 70 cm×30 cm) were introduced into the solution, and washed for 7 minutes. After spin-drying, the towels were subjected to a 3-minute rinsing in 5 L of water, spin-drying, a 3-minute rinsing, spin-drying, and air-drying.

Sensory evaluation of the feel of softness was conducted by the five individuals using the cotton towel washed with the softening detergent composition and the pre-treated towel as a pair for evaluation. The case where there is no difference or where the washed towel is rather harder than the pre-treated towel is ranked score 0; the case where the washed towel is slightly softened is ranked score 1, the case where the washed towel is softened to some extent is ranked score 2, the case where the washed towel is clearly softened is ranked score 3. The softening ability for a total score of five individuals was evaluated as follows.

Evaluation Criteria:

A: A total score of five individuals is score 10 or higher.

B: A total score of five individuals is score 5 or higher and less than score 10.

C: A total score of five individuals is less than score 5.

TABLE 2

| | Examples | | | Comparative Examples | | |
|---|---|---|---|---|---|---|
| | I-1 | I-2 | I-3 | I-1 | I-2 | I-3 |
| Component Corresponding to Surfactant as Prescribed in JIS K 3362: 1998 (% by mass) | 28 | 24 | 21 | 21 | 28 | 21 |
| Evaluation for Detergency | A | A | A | A | A | A |
| Evaluation for Softening Ability | A | A | A | C | C | C |

It can be seen from the results of Tables 1 and 2 that since the components 10 (a), (b), and (c) are formulated in given concentrations and ratios in the softening detergent compositions of Examples I-1 to I-3, the softening detergent compositions with enhanced softening effects are obtained.

Examples II-1 to II-12 and Comparative Examples II-1 to II-3

A detergent base was obtained from components excluding a clay mineral, a bleaching agent granule, a bleaching activator granule, an enzyme, a perfume, and 3% by mass of a zeolite for surface modification. To the detergent base were added and mixed the clay mineral, the bleaching agent granule, the bleaching activator granule, the enzyme, the perfume, and 3% by mass of the zeolite for surface modification, to give a softening detergent composition. The components of the softening detergent composition are shown in Tables 3 and 4.

All of the obtained softening detergent compositions had a pH of their 0.05% by mass aqueous solutions in the range of from 10 to 11, as determined by the method as prescribed in JIS K3362:1998 at 20° C., an amount of calcium ions captured in the range of from 50 to 200 $CaCO_3$ mg/g, an average particle size in the range of from 300 to 800 μm, and a bulk density in the range of from 700 to 980 g/L.

TABLE 3

| Components (% by mass) of Softening Detergent | Examples | | | | |
|---|---|---|---|---|---|
| Composition | II-1 | II-2 | II-3 | II-4 | II-5 |
| Component a | | | | | |
| Clay Mineral | 10 | 10 | 5 | 20 | 15 |
| Component b | | | | | |
| Bleaching Agent Granule 1 | | | 5 | | 5 |
| Bleaching Agent Granule 2 | 5 | 2 | | 7 | |
| Bleaching Activator Granule 1 | | | 0.5 | | 1 |
| Component c | | | | | |
| Bleaching Activator Granule 2 | 3 | | 0.5 | 7 | |
| Bleaching Activator Granule 3 | | 1 | | | 1 |
| LAS-Na | 10 | 8 | 22 | 12 | 9 |
| AS-Na | | | 5 | 5 | 3 |
| ES-Na | | | | | 1 |
| α-SFE | | 10 | | | |
| Component d | | | | | |
| Sodium Salt of Fatty Acid 1 | 2 | 7 | 3 | 2 | 10 |
| Nonionic Surfactant 1 | 8 | | 2 | | 2 |
| Nonionic Surfactant 2 | | 3 | | | |
| Nonionic Surfactant 3 | | | 1 | | |
| Component e | | | | | |
| Crystalline Silicate | 8 | | 5 | | |
| No. 2 Silicate | | 1 | 3 | 3 | 1 |
| Zeolite | 25 | 25 | 20 | 10 | 20 |
| Sodium Carbonate | 12 | 10 | 10 | 22 | 24 |
| Potassium Carbonate | | 14 | 7 | | |
| Sodium Sulfate | 9 | 2 | 3 | 4 | 2 |
| Sodium Tripolyphosphate | | | | | |
| PEG | 1 | | 1 | 1 | |
| AA Polymer | 3 | | | 3 | |
| AA/MA Polymer | | 3 | 3 | | 2 |
| Others | | | | | |
| Fluorescer | 0.2 | 0.2 | 0.2 | 0.2 | 0.2 |
| Enzyme | 1 | 1 | 1 | 1 | 1 |
| Perfume | 0.3 | 0.3 | 0.3 | 0.3 | 0.3 |
| Water | 2.5 | 2.5 | 2.5 | 2.5 | 2.5 |

| Components (% by mass) of Softening Detergent | Examples | | Comparative Examples | | |
|---|---|---|---|---|---|
| Composition | II-6 | II-7 | II-1 | II-2 | II-3 |
| Component a | | | | | |
| Clay Mineral | 10 | 10 | 10 | 10 | 10 |
| Component b | | | | | |
| Bleaching Agent Granule 1 | 6 | | | | |
| Bleaching Agent Granule 2 | | 5 | | | 5 |
| Bleaching Activator Granule 1 | 2 | | | | |
| Component c | | | | | |
| Bleaching Activator Granule 2 | 3 | 0.5 | | 1 | |
| Bleaching Activator Granule 3 | | | | | |
| LAS-Na | 12 | 10 | 10 | 10 | 10 |
| AS-Na | 4 | | | | |
| ES-Na | | | | | |
| α-SFE | | | | | |
| Component d | | | | | |
| Sodium Salt of Fatty Acid 1 | 4 | 2 | 2 | 2 | 2 |
| Nonionic Surfactant 1 | 1 | 8 | 8 | 8 | 8 |
| Nonionic Surfactant 2 | | | | | |
| Nonionic Surfactant 3 | | | | | |

TABLE 3-continued

| Component e | | | | | |
|---|---|---|---|---|---|
| Crystalline Silicate | | 2 | 8 | 8 | 8 |
| No. 2 Silicate | 1 | | | | |
| Zeolite | 15 | 28.5 | 25 | 25 | 25 |
| Sodium Carbonate | 15 | 15 | 12 | 12 | 12 |
| Potassium Carbonate | 4 | | | | |
| Sodium Sulfate | 3 | 11 | 17 | 16 | 12 |
| Sodium Tripolyphosphate | 15 | | | | |
| PEG | 0.5 | 1 | 1 | 1 | 1 |
| AA Polymer | | 3 | 3 | 3 | 3 |
| AA/MA Polymer | 0.5 | | | | |
| Others | | | | | |
| Fluorescer | 0.2 | 0.2 | 0.2 | 0.2 | 0.2 |
| Enzyme | 1 | 1 | 1 | 1 | 1 |
| Perfume | 0.3 | 0.3 | 0.3 | 0.3 | 0.3 |
| Water | 2.5 | 2.5 | 2.5 | 2.5 | 2.5 |

TABLE 4

| Components (% by mass) of Softening Detergent | Examples | | | | |
|---|---|---|---|---|---|
| Composition | II-8 | II-9 | II-10 | II-11 | II-12 |
| Component a | | | | | |
| Clay Mineral | 5 | 12 | 8 | 10 | 8 |
| Component b | | | | | |
| Bleaching Agent Granule 1 | | | 2 | | |
| Bleaching Agent Granule 2 | 2 | 3 | | 4 | 2 |
| Bleaching Activator Granule 1 | | 0.5 | 0.5 | | |
| Component c | | | | | |
| Bleaching Activator Granule 2 | 1.5 | 1 | 1 | 0.5 | |
| Bleaching Activator Granule 3 | | | | 1 | 1 |
| LAS-Na | | 18 | 15 | 18 | 6 |
| AS-Na | 18 | 3 | 8 | 5 | 6 |
| Component d | | | | | |
| Sodium Salt of Fatty Acid 1 | 8 | 4 | 2 | 3 | 3 |
| Nonionic Surfactant 1 | 2 | 2 | 1 | | 5 |
| Nonionic Surfactant 2 | | 3 | | | 5 |
| Nonionic Surfactant 3 | 1 | | 1 | | |
| Component e | | | | | |
| Crystalline Silicate | | | | 1 | |
| No. 2 Silicate | 1 | 8 | 1 | | 4 |
| Zeolite | 25 | 25 | 10 | 10 | 28 |
| Sodium Carbonate | 20 | 10 | 25 | 20 | 12 |
| Potassium Carbonate | 5 | | | | 6 |
| Amorphous Aluminosilicate | | | | | 3 |
| Sodium Sulfate | 2.5 | 2.5 | 2.5 | 2.5 | 6 |
| Sodium Tripolyphosphate | | | 18 | 20 | |
| PEG | 1 | 1 | 0.5 | 0.5 | 1 |
| AA Polymer | 1 | | | 0.5 | |
| AA/MA Polymer | 2 | 3 | 0.5 | | 1 |
| Others | | | | | |
| Fluorescer | 0.2 | 0.2 | 0.2 | 0.2 | 0.3 |
| Enzyme | 0.5 | 0.5 | 0.5 | 0.5 | 0.5 |
| Perfume | 0.3 | 0.3 | 0.3 | 0.3 | 0.2 |
| Water | 3 | 3 | 3 | 3 | 2 |

Also, the detergency and the softening ability of the resulting softening detergent composition were evaluated in the same manner as above. The results are shown in Tables 5 and 6.

TABLE 5

| | Examples | | | | |
|---|---|---|---|---|---|
| | II-1 | II-2 | II-3 | II-4 | II-5 |
| Component Corresponding to Surfactant as Prescribed in JIS K 3362: 1998 (% by mass) | 21 | 29 | 34 | 27 | 26 |
| Evaluation for Detergency | A | A | A | A | A |
| Evaluation for Softening Ability | B | A | A | A | A |

| | Examples | | Comparative Examples | | |
|---|---|---|---|---|---|
| | II-6 | II-7 | II-1 | II-2 | II-3 |
| Component Corresponding to Surfactant as Prescribed in JIS K 3362: 1998 (% by mass) | 25 | 21 | 20 | 21 | 20 |
| Evaluation for Detergency | A | A | A | A | A |
| Evaluation for Softening Ability | B | B | C | C | C |

TABLE 6

| | Examples | | | | |
|---|---|---|---|---|---|
| | II-8 | II-9 | II-10 | II-11 | II-12 |
| Component Corresponding to Surfactant as Prescribed in JIS K 3362: 1998 (% by mass) | 31 | 32 | 28 | 28 | 26 |
| Evaluation for Detergency | A | A | A | A | A |
| Evaluation for Softening Ability | B | B | B | B | A |

It can be seen from the results of Tables 3 to 6 that since the components (a), (b), (c) and (d) are formulated in given concentrations and ratios in the 5 softening detergent compositions of Examples II-1 to II-12, the softening detergent compositions with enhanced softening effects are obtained.

Examples III-1 to III-4, and Comparative Examples III-1 to III-4

A detergent base having the components shown in Table 7 was obtained in the same manner as in Example II-1. To the detergent base were added and mixed the clay mineral, the bleaching agent granule, the bleaching activator granule, the enzyme, the perfume, and the zeolite for surface modification, to give a softening detergent composition. All of the obtained softening detergent compositions had a pH of their 0.05% by mass aqueous solutions in the range of from 10 to 11, as determined by the method as prescribed in JIS K3362: 1998 at 20° C., an amount of calcium ions captured in the range of from 50 to 200 $CaCO_3$ mg/g, an average particle size in the range of from 300 to 800 μm, and a bulk density in the range of from 700 to 980 g/L.

Also, the detergency and the softening ability of the resulting softening detergent composition were evaluated in the same manner as above. As a result, all of the softening detergent compositions of Examples III-1 to III-4 had better softening detergency effects than those of Comparative Examples III-1 to III-4.

TABLE 7

| Components (parts by mass) of Softening Detergent Composition | Examples | | | |
|---|---|---|---|---|
| | III-1 | III-2 | III-3 | III-4 |
| Component a | | | | |
| Clay Mineral | 10 | 10 | 10 | 10 |
| Component b | | | | |
| Bleaching Agent Granule 1 | 10 | 2.5 | 2.5 | 10 |
| Component c | | | | |
| Bleaching Activator Granule 2 | 6 | 1.5 | 1.5 | 6 |
| Component d | | | | |
| Sodium Salt of Fatty Acid 2 | | 1 | 8 | 8 |
| LAS-Na | 10 | 10 | 10 | 10 |
| Nonionic Surfactant 1 | 5 | 5 | 5 | 5 |
| Component e | | | | |
| Crystalline Silicate | 2 | 2 | 2 | 2 |
| Zeolite | 25 | 25 | 25 | 25 |
| Sodium Carbonate | 22 | 22 | 22 | 14 |
| Sodium Sulfate | 2 | 13 | 6 | 2 |
| PEG | 1 | 1 | 1 | 1 |
| AA Polymer | 3 | 3 | 3 | 3 |
| Others | | | | |
| Fluorescer | 0.2 | 0.2 | 0.2 | 0.2 |
| Enzyme | 1 | 1 | 1 | 1 |
| Perfume | 0.3 | 0.3 | 0.3 | 0.3 |
| Water | 2.5 | 2.5 | 2.5 | 2.5 |
| Component Corresponding to Surfactant as Prescribed in JIS K 3362: 1998 (% by mass) | 21 | 18 | 25 | 29 |
| Evaluation for Detergency | A | A | A | A |
| Evaluation for Softening Ability | B | B | A | A |

| Components (parts by mass) of Softening Detergent Composition | Comparative Examples | | | |
|---|---|---|---|---|
| | III-1 | III-2 | III-3 | III-4 |
| Component a | | | | |
| Clay Mineral | | 10 | 10 | 10 |
| Component b | | | | |
| Bleaching Agent Granule 1 | | | 2.5 | |
| Component c | | | | |
| Bleaching Activator Granule 2 | | | 1.5 | |
| Component d | | | | |
| Sodium Salt of Fatty Acid 2 | | | | 1 |
| LAS-Na | 10 | 10 | 10 | 10 |
| Nonionic Surfactant 1 | 5 | 5 | 5 | 5 |
| Component e | | | | |
| Crystalline Silicate | 2 | 2 | 2 | 2 |
| Zeolite | 25 | 25 | 25 | 25 |
| Sodium Carbonate | 22 | 22 | 22 | 22 |
| Sodium Sulfate | 28 | 18 | 14 | 17 |
| PEG | 1 | 1 | 1 | 1 |
| AA Polymer | 3 | 3 | 3 | 3 |
| Others | | | | |
| Fluorescer | 0.2 | 0.2 | 0.2 | 0.2 |
| Enzyme | 1 | 1 | 1 | 1 |
| Perfume | 0.3 | 0.3 | 0.3 | 0.3 |
| Water | 2.5 | 2.5 | 2.5 | 2.5 |
| Component Corresponding to Surfactant as Prescribed in JIS K 3362: 1998 (% by mass) | 16 | 16 | 17 | 17 |
| Evaluation for Detergency | A | A | A | A |
| Evaluation for Softening Ability | C | C | C | C |

In addition, excellent detergency and softening ability were exhibited even in a case where a softening detergent composition were prepared using each of the following components (a), (b) and (d) as the components for each of the softening detergent compositions in Examples I-1 to I-3, Examples II-1 to II-12 and Examples III-1 to III-4 mentioned above:

Component (a): "Laundrosil PR414" or "Laundrosil DGA Powder" commercially available from Süd-Chemie, or "Detersoft G1S", "Detersoft G1B", or "Detersoft G1SW" commercially available from Laviosa;

Component (b): potassium carbonate-hydrogen peroxide adduct;

Component (d): sodium myristate, sodium palmitate, sodium stearate, sodium linoleate, or sodium linolenate.

Here, in Examples, the followings were used as each of the components.

Clay Mineral: "Laundrosil DGA212" (commercially available from Süd-Chemie, bentonite)

Nonionic Surfactant 1: an ethylene oxide adduct prepared by adding ethylene oxide in an average of 8 mol to a primary alcohol having 10 to 14 carbon atoms;

Nonionic Surfactant 2: an ethylene oxide adduct prepared by adding ethylene oxide in an average of 7 mol to a secondary alcohol having 12 to 14 carbon atoms;

Nonionic Surfactant 3: an ethylene oxide-propylene oxide adduct prepared by adding to a secondary alcohol having 12 to 14 carbon atoms an average of 9 mol of ethylene oxide and an average of 1 mol of propylene oxide, sequentially in block addition;

Bleaching Agent Granule 1: sodium borate-hydrogen peroxide adduct;

Bleaching Agent Granule 2: sodium carbonate-hydrogen peroxide adduct (sodium percarbonate), the bleaching granule disclosed in JP-A-2000-256699, paragraph 0019);

Bleaching Activator Granule 1: N,N,N',N'-tetraacetylethylenediamine (not the component (c) as referred to in the present invention);

Bleaching Activator Granule 2: sodium lauroyloxybenzenesulfonate granules (the bleaching granule disclosed in JP-A-2000-256699, paragraph 0018);

Bleaching Activator Granule 3: being prepared by the same procedures as those for Bleaching Activator Granule 2, except for using sodium nanoyloxybenzenesulfonate in place of sodium lauroyloxybenzenesulfonate, to give a bleaching activator granule 3;

LAS-Na: a sodium linear alkylbenzenesulfonate of which alkyl moiety has 12 to 14 carbon atoms;

AS-Na: a sodium alkyl sulfate of which alkyl moiety has 12 to 16 carbon atoms;

ES-Na: sodium polyoxyethylene (average number of EO added: 1 mol) alkyl(12 to 16 carbon atoms) sulfate;

α-SFE: sodium salt of methyl ester of α-sulfofatty acid of which alkyl moiety has 12 to 14 carbon atoms;

Sodium Salt of Fatty Acid 1: sodium salt of a fatty acid of which alkyl moiety has 14 to 18 carbon atoms;

Sodium Salt of Fatty Acid 2: sodium oleate;

Crystalline Silicate: "Prefeed granules" (commercially available from K.K. Tokuyama Siltex);

PEG: polyethylene glycol (weight-average molecular weight: 10000);

AA Polymer: polyacrylic acid (average molecular weight: 15000; determined by GPC, calculated as polyethylene glycol);

AA/MA Polymer: acrylic acid-maleic acid copolymer (sodium salt (70% by mol neutralization), the monomer ratio being acrylic acid/maleic acid=3/7 (molar ratio), average molecular weight: 70000);

Fluorescer: "Tinopal CBS-X" (commercially available from Ciba Geigy AG); and

Enzyme: "Cellulase K" (disclosed in JP-A-Sho 63-264699),

"Kannase 24TK" (commercially available from Novozymes), and

"Savinase 6.0T" (commercially available from Novozymes) were used in a mass ratio of 3:1:2.

The softening detergent composition of the present invention can be suitably used as a softening detergent for fibrous manufactured articles such as clothes representatively exemplified by, for instance, towels or bath towels made of cotton, T-shirts and sweat shirts.

The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A softening detergent composition comprising:

(a) 1 to 30% by mass of a clay mineral represented by formula (3):

$$[Si_8(Mg_aAl_b)O_{20}(OH)_4]^{x-}.Me^{x+}$$

wherein each of a, b and x satisfies $0<a\leqq 6$, $0<b\leqq 4$, $x=12-2a-3b$, and Me is at least one member selected from the group consisting of Na, K, Li, $Ca^{1/2}$, $Mg^{1/2}$ and $NH_4$;

(b) 0.5 to 20% by mass of a sodium carbonate-hydrogen peroxide adduct;

(c) 0.1 to 20% by mass of a compound represented by the following general formula (1) or (2):

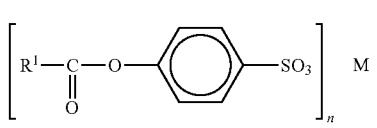

(1)

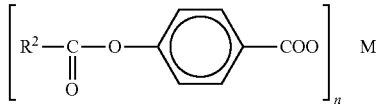

(2)

wherein $R^1$ is an alkyl group having 4 to 13 carbon atoms; $R^2$ is an alkyl group having 5 to 13 carbon atoms; M is a hydrogen atom, or an alkali metal atom, an alkaline earth metal atom, an ammonium or an alkanolamine, with proviso that when M is an alkaline earth metal atom, n is 2, and that when M is an alkali metal atom, an ammonium or an alkanolamine, n is 1, or a combination of both;

(d) 0.4 to 20% by mass of a salt of a fatty carboxylic acid;

a component corresponding to a surfactant other than component (d) which comprises 35-70% by mass of an alkylbenzenesulfonate; and 10 to 60% by mass of a component corresponding to a surfactant as prescribed in JIS K 3362:1998, wherein a mass ratio of the component (b) to the component (c) [component (b)/component (c)] is from 3/4 to 20/1.

2. The softening detergent composition according to claim 1, wherein the amount of the component (b) is from 1.5 to 20% by mass, the amount of the component (c) is from 1.5 to 20% by mass, and the mass ratio of the component (b) to the component (c) is from 3/4 to 7/1.

3. A softening washing method of a fibrous manufactured article, comprising the step of washing an article to be washed with the softening detergent composition of any one of claims 1 to 2.

4. A method of enhancing softening effect of a clay mineral against a fibrous manufactured article, comprising the step of applying to the fibrous manufactured article, (a) a clay mineral represented by formula (3):

$$[Si_8(Mg_aAl_b)O_{20}(OH)_4]^{x-}Me^{x+}$$

wherein each of a, b and x satisfies $0<a\leqq 6$, $0<b\leqq 4$, $x=12-2a-3b$, and Me is at least one member selected from the group consisting of Na, K, Li, $Ca^{1/2}$, $Mg^{1/2}$ and $NH_4$;

(b) a sodium carbonate-hydrogen peroxide adduct; and (c) a compound represented by the following general formula (1) or (2):

(1)

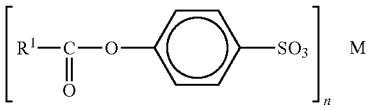

(2)

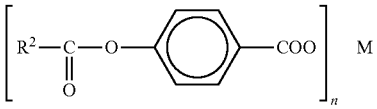

wherein $R^1$ is an alkyl group having 4 to 13 carbon atoms; $R^2$ is an alkyl group having 5 to 13 carbon atoms; M is a hydrogen atom, or an alkali metal atom, an alkaline earth metal atom, an ammonium or an alkanolamine, with proviso that when M is an alkaline earth metal atom, n is 2, and that when M is an alkali metal atom, an ammonium or an alkanolamine, n is 1, or a combination of both;

(d) a salt of a fatty carboxylic acid; and a component corresponding to a surfactant other than component (d) which comprises 35-70% by mass of an alkylbenzenesulfonate, in mass ratios satisfying:

the component (*b*)/the component (*c*)=3/4 to 20/1, and the component (*a*)/the component (*c*)=35/1 to 1/5.

5. The method according to claim 4, wherein the component (a), the component (b) and the component (c) are applied to the fibrous manufactured article in mass ratios satisfying the component (b)/the component (c)=3/4 to 7/1, and the component (a)/the component (c)=30/1 to 1/5.

6. The method according to claim 4, wherein the components (a), the component (b), the component (c) and the component (d) are applied to the fibrous manufactured article in mass ratios satisfying the component (b)/the component (c)=20/1 to 1/1, the component (a)/the component (c)=35/1 to 1/5, and the component (a)/the component (d)=20/1 to 1/5.

7. The softening detergent composition of claim 1, wherein said sodium carbonate-hydrogen peroxide adduct is present in an amount of 2 to 16% by mass.

8. The softening detergent composition of claim 1, wherein said sodium carbonate-hydrogen peroxide adduct is present in an amount of 3.5 to 8% by mass.

9. The softening detergent composition of claim 1, wherein said fatty carboxylic acid is present in an amount of 2.5 to 8% by mass.

10. The softening detergent composition of claim 1, wherein said sodium carbonate-hydrogen peroxide adduct is a coated granule.

11. The softening detergent composition of claim 10, wherein said coated granule is coated with at least one coating selected from the group consisting of boric acids, borates, sodium carbonate, sodium sulfate, magnesium sulfates, magnesium silicate, magnesium chloride, magnesium oxide, sodium silicate, polyethylene glycol, polyvinyl pyrrolidone and hydroxypropyl cellulose.

12. The softening detergent composition of claim 1, further comprising water in an amount of 0.1 to 10% by mass.

* * * * *